US005080240A

United States Patent [19]

Williams

[11] Patent Number: 5,080,240

[45] Date of Patent: Jan. 14, 1992

[54] CAULKING GUN RACK

[76] Inventor: Dennis J. Williams, 22 Parkside Dr., Limestone, N.Y. 14753

[21] Appl. No.: 626,557

[22] Filed: Dec. 12, 1990

[51] Int. Cl.[5] ..... A47F 7/00

[52] U.S. Cl. ..... 211/70.6; 211/13; 211/87

[58] Field of Search ..... 211/70.6, 60.1, 89, 211/64; 248/311.3, 316.7

[56] References Cited

U.S. PATENT DOCUMENTS

| | | | |
|---|---|---|---|
| 945,520 | 1/1910 | Greenwood | 211/64 X |
| 2,102,977 | 12/1937 | Shoemaker et al. | 248/316.7 X |
| 3,802,612 | 4/1974 | Smith | 211/64 X |
| 4,018,339 | 4/1977 | Pritz | 211/64 X |
| 4,159,773 | 7/1979 | Losenno | 211/89 X |
| 4,271,969 | 6/1981 | Gnesa | 211/64 |
| 4,798,297 | 1/1989 | Weiss et al. | 211/89 X |

*Primary Examiner*—Robert W. Gibson, Jr.
*Attorney, Agent, or Firm*—Richard C. Litman

[57] ABSTRACT

A rack, for caulking guns or the standard cartridges which fit them, includes upwardly-projecting cones adapted to plug the opened plastic nozzles of caulking cartridges when the cartridge nozzles are lowered onto the cones. An air-tight seal is formed as the plastic nozzle of a cartridge conforms to and grips the cone. The weight of the cartridge helps to insert the cone. The rack includes grips disposed above the cones for holding either cartridges, or guns with cartridges therein. The grips are of the resilient arm type, preferably with rubber-covered arms so the that the cartridges, after being forced down onto the cones, will not work upward. The rack includes a serrated nozzle-cutting edge and a holder for a nail to puncture the inner membrane of a cartridge.

7 Claims, 1 Drawing Sheet

CAULKING GUN RACK

FIELD OF THE INVENTION

The present invention relates to caulking gun racks, for storing caulking guns of the type which accept a cylindrical cartridge having a nozzle extending from the cartridge for extruding the caulking or other material inside the cartridge.

DESCRIPTION OF THE PRIOR ART

Caulking guns find widespread use in industrial and household applications. They are used with standardized cartridges or "tubes". The cartridges may contain, not only the caulking from which the name derives, but also a wide variety of other viscous substances, such as waterproofing adhesives and sealants, which may be useful in construction for bonding materials together or in the home for filling in cracks of a window frame and joints of a pipe to prevent leakage.

The typical caulking gun is a metal half-tube with a stop on one end and a plunger in the other. The half-tube includes a handle and trigger extending from the handle which forcibly drives the plunger along the tube. A cylindrical cardboard cartridge containing caulking is inserted into the gun. A nozzle, integral with the cartridge, extends through a passage in the stop; the plunger inserts into the cartridge for extruding caulking through the nozzle when the plunger drives a piston into the cartridge.

The standard cartridges and caulking guns which load them are successful because of their ability to dispense caulking or other material directly into a corner, groove, or crack, because no caulking knife is needed, and because there is minimal mess and spread of material.

Despite the success of caulking guns and their standard cartridges, there are some problems caulking guns are difficult to store due to their awkward shape, and the cartridges may dribble. The greatest problem, though, is loss of material due to solidification. This is caused by air contact with the material in opened cartridges.

Most of the viscous materials purveyed in standard cartridges solidify in the presence of air. To preserve the contents prior to use, manufacturers place a metal foil barrier at the base of the nozzle, which is punctured prior to use with a nail, awl, or similar instrument. Once this foil is broken and the nozzle cut, air is in contact with the material at the nozzle opening. It thus tends to solidify and clog the opening. Once this happens, the solidified material must be dug out so that the remaining mass of still-viscous material can escape and be used. Removal of the solid material is very difficult due to the small size of the nozzle opening.

To prevent this, users resort to jamming any handy object into the opening. Nails, screws, tools, and the like are resorted to. Despite the ingenuity of users, the material still dries because the makeshift stopgaps are the wrong diameter or not smooth. Often an entire cartridge must be discarded because the material in the nozzle is so dried that it cannot be removed.

Accordingly, one object of the present invention is a means of quickly and simply plugging caulking gun cartridge nozzles to prevent contact of ambient air with the material inside the nozzle.

Another object is a rack for conveniently storing either caulking guns or cartridges so that they are readily available, quickly replaced, and so that they are displayed for ease of selection among several cartridges containing various materials.

A final object is a rack which includes a tray to catch drips in case of leakage.

These and other objects of the present invention will become readily apparent upon further review of the following specification and drawings.

SUMMARY OF THE INVENTION

The present invention is a rack, for caulking guns or the standard cartridges which fit them, which includes upwardly-projecting cones adapted to plug the opened plastic nozzles of caulking cartridges when the cartridge nozzles are lowered onto the cones. An air-tight seal is formed as the plastic nozzle of a cartridge conforms to and grips the cone. The weight of the cartridge helps to insert the cone. The rack includes grips disposed above the cones for holding either cartridges, or guns with cartridges therein. The grips are of the resilient arm type, preferably with rubber-covered arms so the that the cartridges, after being forced down onto the cones,. will not work upward. The rack includes a serrated nozzle-cutting edge and a holder for a nail to puncture the inner membrane of a cartridge.

DETAILED DESCRIPTION OF THE PREFERRED EMBODIMENT

Figure 1:
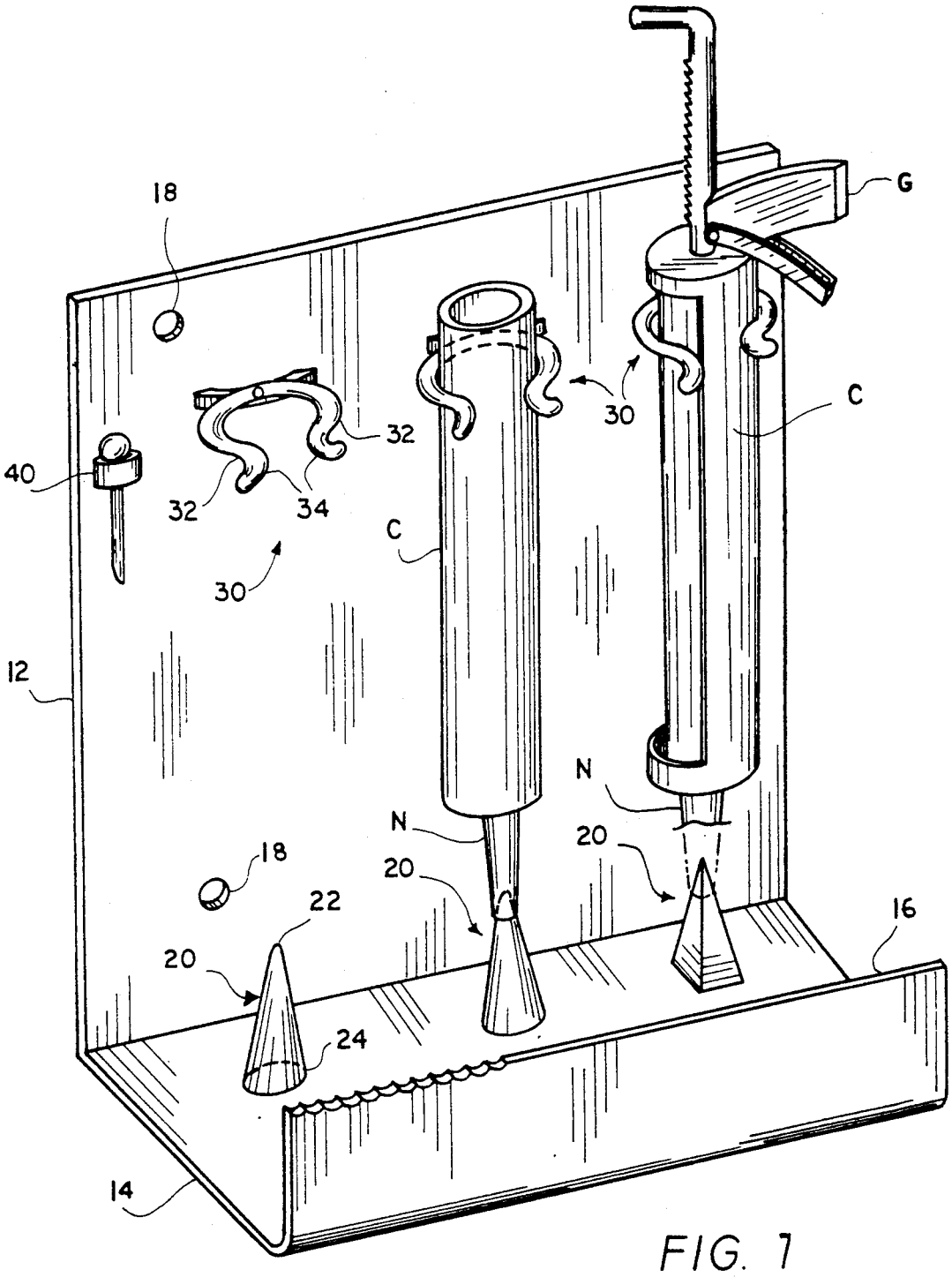
FIG. 1 is a perspective view of the present invention showing the sheet metal rack frame, conical and pyramidal plugs for cartridge nozzles, and grips. A cartridge and gun with loaded cartridge are also shown in use with the rack.

The present invention, a caulking gun rack, is shown in FIG. 1. The rack consists of a frame 10, preferably made of a rectangular piece of sheet metal bent into the L-shape shown, comprising a back plate 12 and a drip pan 14, at roughly a right angle to the back plate 12. A lip 16 may be included to strengthen the edge of the drip pan 14. The frame back plate 12 includes screw holes 18 for attaching the frame to a wall, where the rack will normally be mounted. The frame 10 may also be hung, or mounted horizontally or on an inclined surface. A vertical position is preferred because the weight of the cartridges will then tend to tighten the stopping of the nozzle by the cone; this is explained below.

The frame should be sufficiently strong to support the weight of the cartridges and guns,. and ordinary forces of use.

Attached to the drip pan 14 are cones 20, which plug the open nozzles N of standard cartridges C.

In this specification and in the following claims, the word "cartridge" means a holder for viscous materials. "Standard cartridge" means the ordinary type found in hardware stores, in which caulking, glue, and the like are sold. Such cartridges are cylindrical, about 2 inches in diameter and about 9 inches long not counting the nozzle. Each cartridge includes a nozzle for extruding the contents, and a piston for driving the material out through the nozzle.

The nozzle (N in FIG. 1) is universally of semi-rigid plastic which can be cut with a saw or knife. The nozzle is usually round and tapered so that the user can pick the size and shape of nozzle orifice desired by cutting at the appropriate point and angle. The typical dimensions of the standard cartridge nozzle are about one half inch at the base.

Although round, tapered nozzles are nearly universal, some standard cartridges are equipped with nozzles of other shapes. One type is square in cross section and is precut at an angle. The drawing shows one pyramidal "cone" adapted to this type of nozzle, on the right.

Also, in this specification and in the following claims, the term "caulking gun" means a device which is used to extrude material from standard cartridges. Caulking guns are as much standardized as the cartridges themselves. FIG. 1 shows a caulking gun G.

To stop a round or conical nozzle in the case of all possible cuts by a user, the cone base 24 must be of diameter at least as great as the inner diameter of the nozzle: i.e., the maximum cone external diameter should be greater than or equal to the maximum internal nozzle diameter, that is, about half an inch. Conversely, the smallest diameter of the cone must be less than the smallest anticipated nozzle opening, which is of the order of a sixteenth of an inch. The cone should not be any sharper than is necessary, for safety. The tip 22 may be flat (truncated cone), rounded, tapered at a greater conical angle. etc.

The length of the cone is important. If the cone is too long, it will penetrate too far into the nozzle, be weakened, and prevent a cartridge from sitting down in the rack, making it top heavy.

If the cone is too short, then the cone will not be able to stop a nozzle which has been cut at a steep angle (that is, far from transverse to the axis of the nozzle). This is because the only moderately resilient plastic of the nozzle will not stretch sufficiently to make up for a gross geometrical mismatch.

Also, the physics of the contact between the cone and nozzle favor a steep-sided cone. This is because the cone will be forced up into the nozzle orifice when the cartridge is mounted in the rack, to create a constrictive pressure of the nozzle orifice on the cone surface by the stretching of the nozzle orifice. A component of the constrictive force in the vertical direction will tend to raise the nozzle away from the cone, thus lessening the constrictive force, and encouraging breaking of the air seal. The steeper the cone, the less is this component of force.

The cone should be of a material which is fairly strong, has a smooth surface, and is easily cleaned or resists adherence by glues and the like. Steel, nylon, and TEFLON are possibilities. Composite structures are also possible: for example, a steel core covered with plastic. The cones 20 may be attached to the drip pan 14 by any convenient method.

The conical shape is preferred for the large majority of standard cartridge nozzles. As noted above, some nozzles depart from the round or tapered shape: if these are expected, some of the cones should be pyramidal to plug them. Various shapes may be needed if manufacturers introduce new nozzle shapes.

In view of the above, the word "cone" in this specification is meant to include a cone a frustum of a cone, and objects generally conical or departing slightly from a conical shape for example: cones with somewhat elliptical cross sections; cones that are curved somewhat like a horn; cones with bases or tops not cut perpendicular to the axis of the cone; cones with rounded tops or tips; cones with surface indentations rings, and the like; and so on. The invention does not require a mathematically perfect cone, rather, it requires a generally conical solid which is adapted to seal a caulking gun cartridge.

In the claims, the word "cone" is further intended to mean not only cones but also pyramids or other polygonal tapered shapes which may be suitable for plugging nozzles of non-circular or non-elliptical cross sections.

Once the nozzle N has been lowered onto the cone 20, the body of the cartridge C is placed into the grip 30. The grip includes two resilient metal arms 32, with a gap between them, which together describe a circle slightly smaller than the diameter of a cartridge C. The arms 32 must enclose more than a straight angle (180 degrees). Thus, when a cartridge C is forced between them they exert force which prevents the cartridge from falling out. The resilience of the arms 32 should be great enough to allow a caulking gun G, with cartridge C loaded, to be inserted; then the cartridge need not be laboriously removed from the gun. As the gun is not much larger in diameter than the cartridge, this is simple to insure.

The arms include lips 34 and rubber arm coverings. The lips aid insertion of a cartridge, and the rubber creates friction for a secure hold. The grip is attached by a bolt, rivet, etc.

The grip illustrated is preferred, but is only one possible type. In fact, the grip could be as simple as a hoop or ring through which the gun or cartridge could be inserted prior to plugging by the cone. In general the present invention is not limited to the sole embodiment described above, but encompasses any and all embodiments within the scope of the following claims.

A holder 40 is useful for keeping handy an awl, nail, or similar tool for puncturing the foil membrane of a new cartridge.

I claim:

1. A rack for holding at least one cartridge of the type having a cylindrical hollow body for containing viscous material, a piston slidably disposed within a bore of said hollow body and adapted to seal said viscous material within said body, a cap at one end of said hollow body, and a plastic nozzle extending from said cap for extruding said viscous material from said body when said piston is forced into said bore to pressurize said viscous material, said plastic nozzle having a generally conical interior, said interior having a minimum internal diameter, said rack including:

a rack frame;

at least one cone fixed to said frame, said cone having a minimum cone diameter less than or equal to said minimum internal diameter of said plastic nozzle;

a respective grip for said cone, said grip attached to said rack frame, said grip distal the base of said cone, said grip adapted to releasably hold said cartridge, said grip further adapted to releasably hold a caulking gun containing said cartridge, said grip so disposed that when holding said cartridge an axial line extending from the axis of said cone generally coincides with the axis of said cartridge; whereby said cone may be inserted into said nozzle for sealing air from said viscous material and said cartridge or said caulking gun may be held by said grip for storage thereof.

2. A rack as in claim 1 wherein a plurality of said cones are disposed in a first row, and a plurality of said respective grips are disposed in a second row parallel said first row.

3. A rack as in claim 1 wherein said grip includes a pair of resilient arms, each said arm having a fixed end attached to said rack frame and a free end, each said arm describing a portion of a circle, said portion greater than a right angle in extent, whereby said arms together encircle more than a straight angle for removably holding within said arms a cylindrical object.

4. A rack as in claim 3 wherein said grip includes rubber coverings on said arms for greater friction.

5. A rack as in claim 1 wherein said rack frame includes a back plate and a drip plate, said back plate generally at right angles to said drip plate, said grip is mounted upon said back plate, and said cone is mounted upon said drip plate.

6. A rack as in claim 5 wherein said drip plate includes a serrated edge for cutting said nozzle.

7. A rack as in claim 1 including a nail holder comprising a cylindrical sleeve attached to said frame.

* * * * *